United States Patent [19]

Kawashima et al.

[11] Patent Number: 4,569,265

[45] Date of Patent: Feb. 11, 1986

[54] SLITTER FOR STEEL BELT

[75] Inventors: Hitoshi Kawashima; Yoshikazu Tsujimoto, both of Itami, Japan

[73] Assignee: Toyo Tire & Rubber Co., Ltd., Osaka, Japan

[21] Appl. No.: 455,531

[22] Filed: Jan. 4, 1983

[51] Int. Cl.[4] ..... B26D 5/34

[52] U.S. Cl. ..... 83/368; 83/209; 83/336; 83/345; 83/435.2

[58] Field of Search ..... 83/368, 345, 336, 425, 83/209, 435.2

[56] References Cited

U.S. PATENT DOCUMENTS

| | | | |
|---|---|---|---|
| 2,823,712 | 2/1958 | Ranta | 83/435.2 X |
| 3,417,645 | 12/1968 | Brock | 83/368 |
| 3,719,114 | 3/1973 | Vischulis | 83/368 X |
| 4,070,939 | 1/1978 | Neumeister | 83/368 |
| 4,358,978 | 11/1982 | Lawson | 83/368 X |
| 4,403,533 | 9/1983 | Cox et al. | 83/435.2 X |

FOREIGN PATENT DOCUMENTS

| | | | |
|---|---|---|---|
| 566137 | 11/1958 | Canada | 83/336 |

*Primary Examiner*—Donald R. Schran

*Attorney, Agent, or Firm*—Wenderoth, Lind & Ponack

[57] ABSTRACT

A slitter for steel belt including rotary blades for slitting a belt material including steel cords and topping rubber. The rotary blades include an upper blade and a lower blade having their circumferential portions slightly overlapped and in contact with each other. Sandwiching delivery members for delivering the belt material to the blades is installed either at both sides or one side of the rotary blades in the delivery direction of the belt material so that the belt material is slit in a sandwiched condition. The sandwiching members as well as the rotary blades may be automatically adjusted in position in the transverse direction of the belt material. A freely suspended curved portion of the belt material formed between a delivering device and the slitter may be so controlled as to keep the suspended amount constant.

1 Claim, 4 Drawing Figures

SLITTER FOR STEEL BELT

BACKGROUND OF THE INVENTION

1. Field of the Invention

The present invention relates to an improvement of a slitter for steel belt consisting of steel cords and topping rubber. As being well known, a steel belt has been usually employed as a constituent of an automobile tire. The present invention intends to improve the slitter so as to obtain a steel belt having uniform width throughout the full length.

2. Prior Art

A steel belt employed as a constituent of a radial tire whose width is comparatively narrow is usually provided by the following steps in the prior art. A belt material consisting of steel cords and topping rubber is first cut into a plurality of segments having a comparatively wide width by a bias-cutter. Next, said segments are connected with each other in the longitudinal direction to be rolled as a wider belt material and subsequently said wider belt material is slitted into a steel belt of the desired width by rotary blades installed at a slitter and comprising an upper blade and a lower blade having the circumferential portions slightly overlapped and contacting each other. However, since steel cords are arranged at a small angle with respect to the longitudinal direction of the belt material, a strong force which thrusts steel cords in the transverse direction occurs when the belt material is slitted by rotary blades in the longitudinal direction so that the belt material moves in the transverse direction. Consequently, it is inevitable that the width of the steel belts obtained is not uniform.

Furthermore, since steel cords are arranged at a small angle with respect to the longitudinal direction and have a high elasticity, the belt material is twisted at a freely suspended curved portion formed between a delivering device of the belt material and a slitter, so that the belt material is apt to be delivered not in alignment with the rotary blades. The uniformity of a steel belt is also injured by this inaccurate delivery of the belt material. There have been adopted such countermeasures as making the radius of curvature of a lead-in guide larger which is provided at a slitter for leading the belt material toward rotary blades, and as installing upright guide rollers at each side of the lead-in guide in the direction of movement of the belt material. The results obtained, however, are not satisfactory.

Even a slight off-set of a steel belt relative to the equatorial line of a radial tire badly affects the uniformity of a radial tire, so that it is very important to make the width of a steel belt uniform. Therefore, it is earnestly demanded to improve the accuracy of slitting by a slitter as well as the accuracy of cutting by a bias-cutter.

SUMMARY OF THE INVENTION

It is therefore an object of the present invention to provide an improved slitter for steel belt having improved accuracy of slitting and to obtain a steel belt having the uniform width throughout the full length.

According to the present invention, a slitter for steel belt is provided with sandwiching delivery means including sandwiching members in parallel plane above and below the path of the belt material, which sandwiches a belt material comprising steel cords and topping rubber either at both sides of rotary blades or at one side of rotary blades relative to the transverse direction of a belt material so as to prevent the belt material from being thrusted by the slitting operation with rotary blades comprising an upper blade and a lower blade having the circumferential portions slightly overlapped and contacted with each other.

The sandwiching delivery means may automatically adjust the position in the transverse direction of a belt material as well as rotary blades by driving means which is operated in response to detecting means for detecting the side edges of the belt material, so that a possible dislocation of the belt material relative to the rotary blades can be adjusted and thereby more accurate slitting is obtained.

Accurate slitting may be further guaranteed by the installation of detecting means which detects a lower limit of a freely suspended curved portion of the belt material, formed between a delivering device of the belt material and a slitter, for controlling driving means of the belt material installed at both the delivering device and the slitter to keep the suspending amount of the belt material constant. The delivery condition of the belt material is thereby improved so as not to cause a twisting at the freely suspended curved portion and thereby the accurate delivery of the belt material in alignment with rotary blades can be obtained.

BRIEF DESCRIPTION OF THE DRAWINGS

For a better understanding of the invention, reference is made to the accompanying drawings, in which.

DETAILED DESCRIPTION OF THE INVENTION

Figure 1:
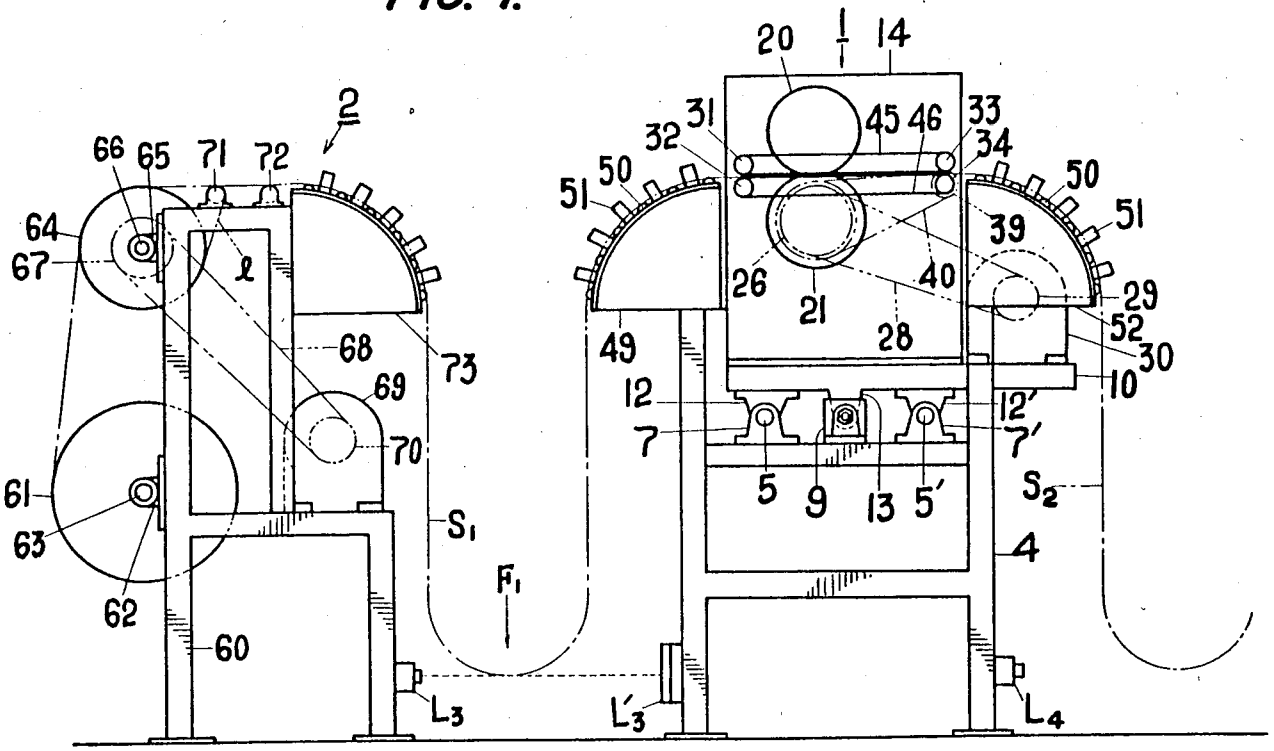
FIG. 1 is a front view of a preferred embodiment of a slitter for steel belt in accordance with the present invention illustrated in conjunction with a preferred embodiment of a delivering device of a belt material to be slitted into a steel belt.
Figure 3:
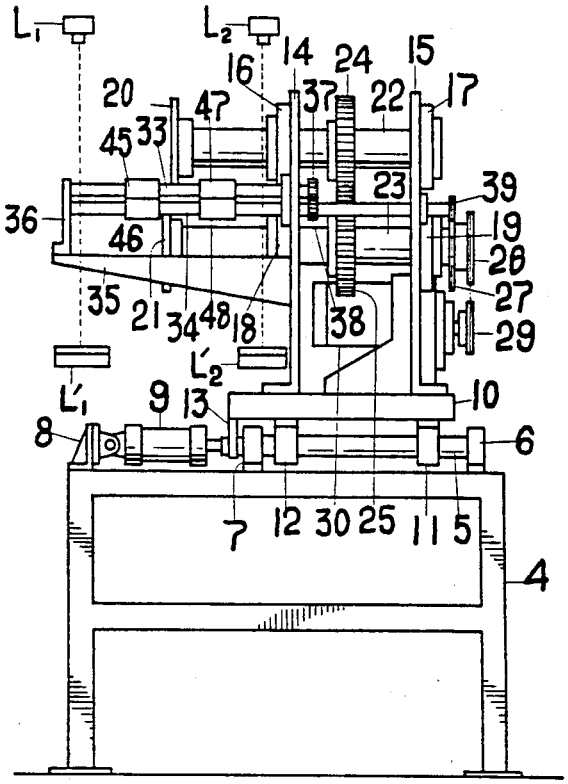
FIG. 3 is a side view of the same slitter as illustrated in FIGS. 1 and 2.
Figure 4:
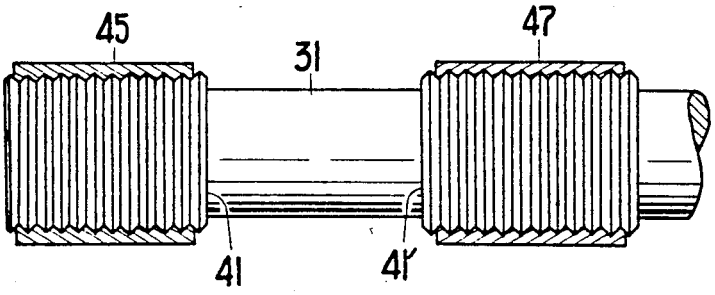
FIG. 4 is an enlarged side view of pulley shafts to which pulleys for endless belts as delivery means for belt material are fixed.

Illustrated in the drawings are a slitter 1, a delivering device 2 of belt material and a winding device 3 for winding of steel belt after being slitted. Referring now to FIG. 1 and FIG. 3 showing an embodiment of the slitter 1, numeral 4 indicates a frame on the top of which brackets 6', 7, 6', 7' are mounted for supporting guide rods 5 and 5'. Slidably mounted to the guide rods 5, 5' by means of supporting elements 11' and 12, 11', 12' is a sliding base 10. A hydraulic cylinder 9 driven by a hydraulic pump and a controlling system is pivotally supported by a block 8 which is mounted at the left end of the frame 4 as best seen in FIG. 3. The sliding base 10 is connected to the piston rod of the hydraulic cylinder 9 by means of a projection 13 at the left end of the sliding base 10 as shown in FIG. 3. Secured on the sliding base 10 are a pair of side plates 14 and 15 having respective bearing portions 16 and 18 and 17 and 19, and blade shafts 22 and 23 respectively securing rotary blades 20 and 21 are respectively mounted by said bearing portions 16 and 17 and 18 and 19. Rotary blades 20 and 21 comprise an upper blade 20 and a lower blade 21 having the circumferential portions slightly overlapped and contacted with each other. Gears 24 and 25, engaging with each other and having the same number of gear tooth, are fixed to the blade shafts 22 and 23, respectively and sprocket wheels 26 and 27 are fixed to the outer end portion of the blade shaft 23 extending beyond the side plate 15. The sprocket wheel 26 is connected by a roller chain 28 to a sprocket wheel 29 of a driving motor 30 which is mounted on the sliding base 10. Pulley shafts 31, 32, 33 and 34 are rotatably supported at one end by a bearing mounted to the side plate 14 and at another end by a bearing member 36 mounted on an arm member 35 secured to the side plate 14. Fixed to end portions of pulley shafts extending beyond the side plate 14 are gears 37 and 38 engaging with each other and having the same number of gear tooth. The pulley shaft 34 further extends outwardly beyond the side plate 15 and at the outermost end portion there is fixed a sprocket wheel 39 connected by a roller chain 40 to the sprocket wheel 27 of the blade shaft 23. As shown in FIG. 4, to the pulley shafts 31, 32, 33 and 34 are fixed respectively two pulleys 41, 41' & 42, 42' & 43, 43' & 44, 44' (only 41, 41' are illustrated) having side-by-side V-shaped grooves over the entire outer surfaces thereof. By means of endless belts 45, 46, 47 and 48 having projections fitting in the V-shaped grooves at their inner faces, pulleys 41–43, 41'–43', 42–44 and 42'–44' are connected. Indicated by $L_1$ and $L'_1$ and $L_2$ and $L'_2$ are detecting means such as image sensors, photoelectric detector, etc. of the side edges of the belt material which are installed at a given position apart from a contact face of rotary blades 20 and 21. The detecting means are associated with an unillustrated controlling system for the hydraulic cylinder 9 which drives the sliding base 10. With reference to FIG. 1, numeral 49 designates a curved lead-in guide mounted to the frame 4 at the side of the delivering device 2 and serves for leading a belt material toward the rotary blades 20 and 21. The lead-in guide 49 is equipped with a lot of ball casters 50 on the curved surface thereof and also equipped with upright guide rollers 51 at each side in the movement direction of the belt material. The radius of curvature of the curved lead-in guide is 300 mm to 400 mm. Mounted to the frame 4 at the side of the winding device 3 is a curved delivery guide 52 which has the same structure as the curved lead-in guide 49 and serves for delivering a steel belt after being slitted.

Referring to the drawing showing the delivering device 2, reference numeral 61, denotes a rolled belt material comprising steel cords and topping rubber which is rolled together with a liner l around a core supported by a bearing shaft 63 mounted to a pair of bearings 62 secured to the frame 60 to obtain the composite belt material $S_1$. A rolled liner 64 is rolled around a core supported by a bearing shaft 66 mounted to a pair of bearings 65 secured to the frame 60. To the bearing shaft 66 is fixed a sprocket wheel 67 connected by a roller chain 68 to a sprocket wheel 70 of a drive motor 69 mounted to the frame 60. Reference numerals 71 and 72 denote guide rollers. Reference numeral 73 denotes a curved delivery guide having the same structure as the delivery guide 52. Indicated by $L_3$, $L'_3$ are photoelectric detecting means for detecting a lower limit of a freely suspended curved portion $F_1$ of the composite belt material $S_1$ between the curved delivery guide 73 and the curved lead-in guide 49, which dispatch analog output depending on the suspended amount of the belt material $S_1$ so as to keep the suspended amount constant by controlling the rotation of the drive motors 30 and 69 with an unillustrated controlling system.

Figure 2:
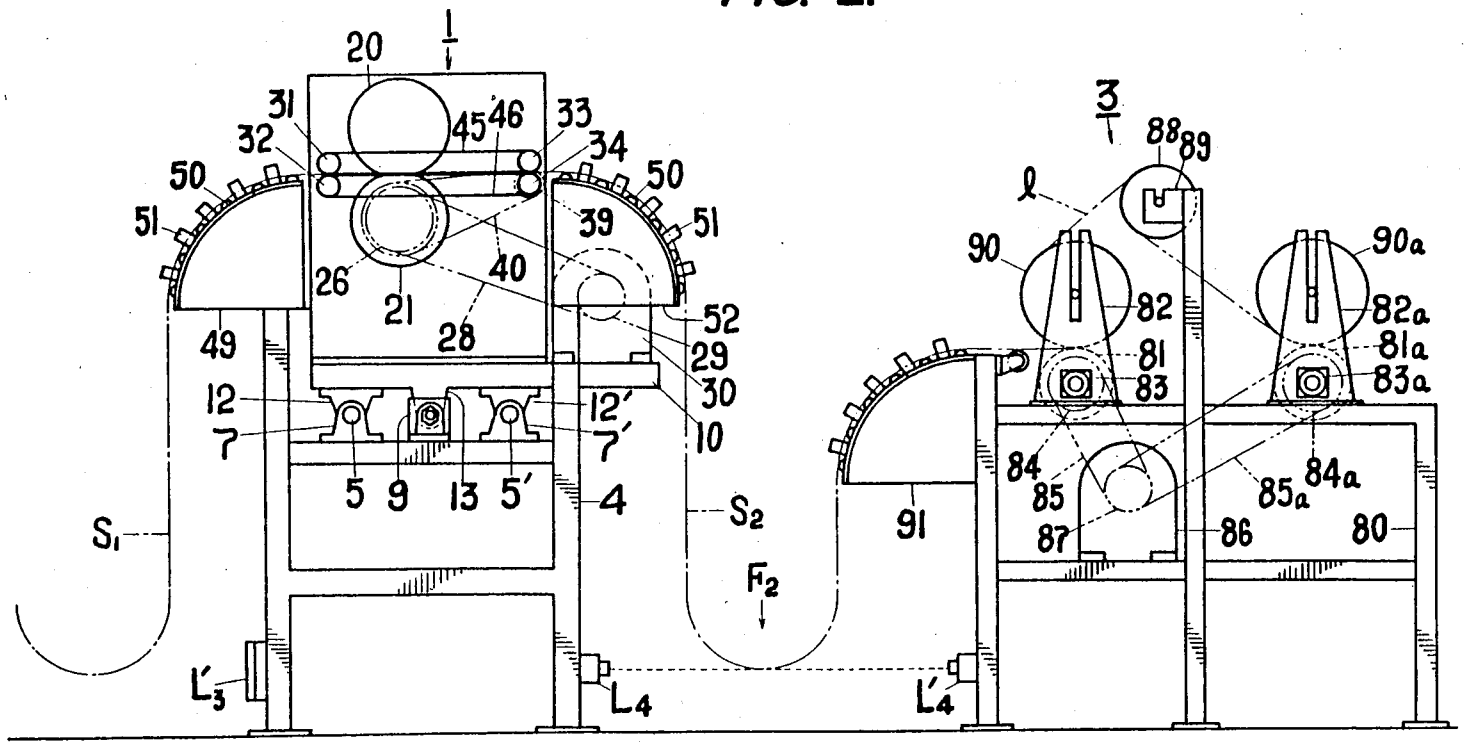
FIG. 2 is a front view of the same slitter as illustrated in FIG. 1, and represented in conjunction with a preferred embodiment of a winding device for winding of steel belt after being slitted by a slitter.

Referring now to FIG. 2 illustrating a winding device 3, reference numeral 80 indicates a frame on which two pairs of said plates 82 and **82*a* are mounted. Under rollers 81 and 81*a* are supported at their axes by bearings 83 and 83*a* secured to the side plates 82 and 82*a*. Sprocket wheels 84 and 84*a* are fixed respectively at the ends of the axes and connected by roller chains 85 and 85*a* to a sprocket wheel 87 of a drive motor 86 mounted on the frame 80. A rolled liner 88 is supported by a pair of receiving plates 89 mounted on the upper portion of the frame 80. Rolled steel belts 90, 90*a* are rolled by the under rollers 83 and 83*a* together with the liner l delivered from the rolled liner 88. A curved lead-in guide 91 has the same structure as the lead-in guide 49. The rolling operation into the rolled steel belt 90, 90*a* is effected by turns. Photoelectric detecting means $L_4$ and $L'_4$a for detecting a lower limit of a freely suspended curved portion $F_2$ of the steel belt $S_2$ serve for keeping the suspended amount constant by controlling the rotation of the drive motor 86** with the unillustrated controlling system.

The slitting operation of a belt material $S_1$ is now described hereunder together with a description of the operation of the delivering device 2 and the winding device 3.

By rotating the drive motor 69 of the delivering device 2, the belt material $S_1$ is delivered from the rolled belt material 61 while the liner l rolled together is separated at a guide roller 71 and rolled around the core supported by bearing shaft 66 to be into the rolled liner 64. The belt material $S_1$ passing through a guide roller 72 and the curved delivery guide 73 is freely suspended. With the freely suspended curved portion $F_1$ formed between the delivery guide 73 and the lead-in guide 49, the free end of the belt material $S_1$ is inserted between the endless belts 45 and 46 and between 47 and 48 through the curved lead-in guide 49 so as to be pressed between the belts. By driving the endless belts 45, 46, 47 and 48 and the rotary blades 20 and 21 by the drive motor 30, the belt material $S_1$ goes forward between two pairs of belts while being slitted by the rotary blades 20 and 21 into the steel belt $S_2$ having a desired width. During the slitting operation by the rotary blades 20 and 21, the belt material $S_1$ is subjected to the strong force to be thrusted in the tranverse direction due to the small angle disposition of steel cords contained therein. But the belt material is never thrusted in the transverse direction by virtue of the pressing of the belt material by the endless belts during the sandwiching delivery of the belt material by the endless belts 45, 46, 47 and 48 whose inner projections closely fit in the grooves of the pulleys 41, 41', 42, 42', 43, 43', 44, 44'. Furthermore, since the detecting means $L_1$ and $L'_1$; and $L_2$ and $L'_2$ detect the side edges of the belt material $S_1$, a possible dislocation of the belt material $S_1$ relative to the rotary blades 20 and 21 can be adjusted by virtue of the adjustment operation of the hydraulic cylinder 9 which drives the sliding base 10 in accordance with the controlling system associated with the detecting means $L_1$ and $L_2$ and $L'_2$. Moreover, the detecting means $L_3$ and $L'_3$ detect the lower limit of the freely suspended curved portion $F_1$ and keep it constant by controlling the rotation of the drive motors 30 and 69, so that the transverse position of the belt material $S_1$ to be led toward the endless belts 45 and 46 and 47 and 48 through the lead-in guide 49 is kept unvaried. Thus, the belt material $S_1$ can be slitted into the steel belt $S_2$ having the uniform width throughout the full length. The steel belt $S_2$ is then delivered to the winding device 3 through the freely suspended curved portion $F_2$ and wound into the rolled steel belt 90, 90*a* by the under rollers 83, 83*a* together with the liner l delivered from the rolled liner 88.

In the above embodiments, the endless belts are used for sandwiching delivery means which sandwich a belt material (axial direction of the blades) at both sides of rotary blades relative to the transverse direction of the belt material, but other equivalent sandwiching delivery means may also be employed either at both sides of rotary blades or at one side of rotary blades relative to the transverse direction. The hydraulic cylinder driving said sandwiching delivery means in the transverse direction of the belt material as well as the rotary blades in order to adjust automatically the position thereof in the transverse direction of the belt material in response to the detecting means of the side edges of the belt material, may be also replaced by other equivalent driving means.

Obviously, many modifications and variations of the present invention are possible in the light of the above teachings. It is therefore to be understood that within the scope of the appended claims in the invention may be practiced otherwise than as specifically described.

What is claimed is:

1. An apparatus for slitting steel belt material formed of steel cords topped with rubber, comprising:

an upper rotary blade, and a lower rotary blade, said upper and lower rotary blades having circumferential portions slightly overlapped and contacting each other, and being rotatable about parallel rotational axes, means, including a drive motor, for rotating said upper and lower blades about said axes, a pair of axially extending pulley shafts rotatable by said motor, pulleys on said pulley shafts, each having a plurality of side-by-side V-shaped grooves over its entire outer surface, means, located on both axial sides of said upper and lower rotary blades, for directing the steel belt material in a longitudinal direction perpendicular to said rotational axes continuously toward and beyond the overlapped portions of said upper and lower rotary blades so as to be cut by said upper and lower rotary blades, said directing means including sandwiching members extending longitudinally from one longitudinal side to the other longitudinal side of said upper and lower rotary blades, so as to press the steel belt material therebetween, whereby the steel belt material is sandwiched between said sandwiching members on both axial sides of said upper and lower rotary blades while being cut by said upper and lower rotary blades, said sandwiching members comprising endless belts trained over said pulleys so as to be rotated by said drive motor through said pulley shafts, said endless belts having a plurality of side-by-side projections over the entire inner surfaces thereof which engage said V-shaped grooves;

detecting means for detecting the side edges of the belt material, and driving means, responsive to detection of the side edges by said detecting means, for automatically adjusting the axial positions of said directing means and said rotary blades;

means for delivering said steel belt material toward said directing means, said delivering means including means for freely suspending a portion of said steel belt material between said delivering means and said directing means; and means for maintaining the lower limit of the suspended portion of the steel belt material at a constant level, said maintaining means including means for sensing when the suspended portion reaches said level and means, responsive to the sensing of the suspended portion by said sensing means, for adjusting the amount of steel belt material delivered toward said directing means to thereby adjust the amount of the suspended portion.

* * * * *